US005848828A

United States Patent [19]

MacLellan

[11] Patent Number: 5,848,828

[45] Date of Patent: Dec. 15, 1998

[54] WORKSTATION SUPPORT SYSTEM

[76] Inventor: Ian MacLellan, 49 Parkhurst Blvd., Toronto, Canada, M4G 2C8

[21] Appl. No.: 781,065

[22] Filed: Jan. 9, 1997

[51] Int. Cl.[6] ..... A47B 97/00

[52] U.S. Cl. ..... 312/291; 211/175; 211/153; 248/346.07; 108/157.13; 312/301

[58] Field of Search ..... 108/42, 90, 33, 108/49, 65, 193, 137, 143, 47, 157.13; 297/149, 148, 153, 188.18; 211/175, 153; 248/346.01, 346.07, 918; 312/194, 208.1, 410, 291, 301, 277, 308, 205, 223.3, 270.3

[56] References Cited

U.S. PATENT DOCUMENTS

| | | | |
|---|---|---|---|
| 904,355 | 11/1908 | O'Connor | 108/47 X |
| 1,247,161 | 11/1917 | Silverman | 297/148 X |
| 2,790,184 | 4/1957 | Testa | 108/65 X |
| 2,986,437 | 5/1961 | Davis | 108/157.13 |
| 3,241,900 | 3/1966 | Hamilton et al. | 312/194 |
| 3,417,875 | 12/1968 | Barker | 211/175 X |
| 4,404,698 | 9/1983 | Koncelik et al. | 108/49 X |
| 4,512,607 | 4/1985 | Rapp | 108/49 X |
| 5,205,631 | 4/1993 | Wegman et al. | 312/208.1 X |
| 5,248,192 | 9/1993 | Tazzia | 312/208.1 X |
| 5,405,194 | 4/1995 | Binder | 312/410 X |
| 5,443,311 | 8/1995 | Kadlecek et al. | 312/291 X |

*Primary Examiner*—JoséV. Chen
*Assistant Examiner*—Janet M. Wilkens

[57] ABSTRACT

A workstation support system which is designed to receive a computer mouse, keyboard and the like comprises a drawer of a desk and a suspension structure within the drawer. The suspension structure comprises a rigid support surface and hangers which fit with the spaced apart sidewalls of the drawer to suspend the support surface in a horizontal position within the drawer. The suspension structure is adjustable to fit different drawer widths.

4 Claims, 4 Drawing Sheets

WORKSTATION SUPPORT SYSTEM

FIELD OF THE INVENTION

The present invention relates to a workstation support system which, rather than fitting on top of a desk, works with a drawer of a desk.

BACKGROUND OF THE INVENTION

Computer systems including screen, keyboard, and screen controls such as a hand operated mouse are found in almost all environments whether they be home or office. Computer desks have been designed specifically for computer systems. Such desks generally have different areas for the different parts of the computer system. These different areas often vary in elevation allowing placement of different parts of the system at different heights. Typically the keyboard and mouse are positioned lower than the terminal where the hands are in a more comfortable position to operate the keyboard and mouse.

There are many desks currently in use which were not designed with computer systems in mind. These desks typically of the slide in drawer type as they are presently set up, require placement of the keyboard and mouse on the desk top in a position which may be one of discomfort and poor ergonomics. The parts of the system cannot be set up at different heights on a conventional slide drawer desk and these desks have relatively limited desk top space such that they become very crowded when all the computer hardware is placed on the desktop.

SUMMARY OF THE INVENTION

The present invention has been developed to make keyboard and mouse position adjustable in existing desks, thus reducing fatigue and discomfort. In addition the system of the present invention is designed to add to both versatility and working surface area of a desk of the type having at least one slide in drawer. More particularly the present invention provides a workstation support system which comprises the drawer of the desk and a suspension structure within the drawer. The suspension structure is formed by a rigid panel having a pair of hangers. The hangers are fitted with the spaced apart sidewalls of the drawer and suspend the panel within the drawer. The suspension structure is adjustable to different drawer widths.

Through the use of the workstation support system of the present invention, the main body of the drawer remains available for storage while a new work surface is created above the contents of the drawer.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
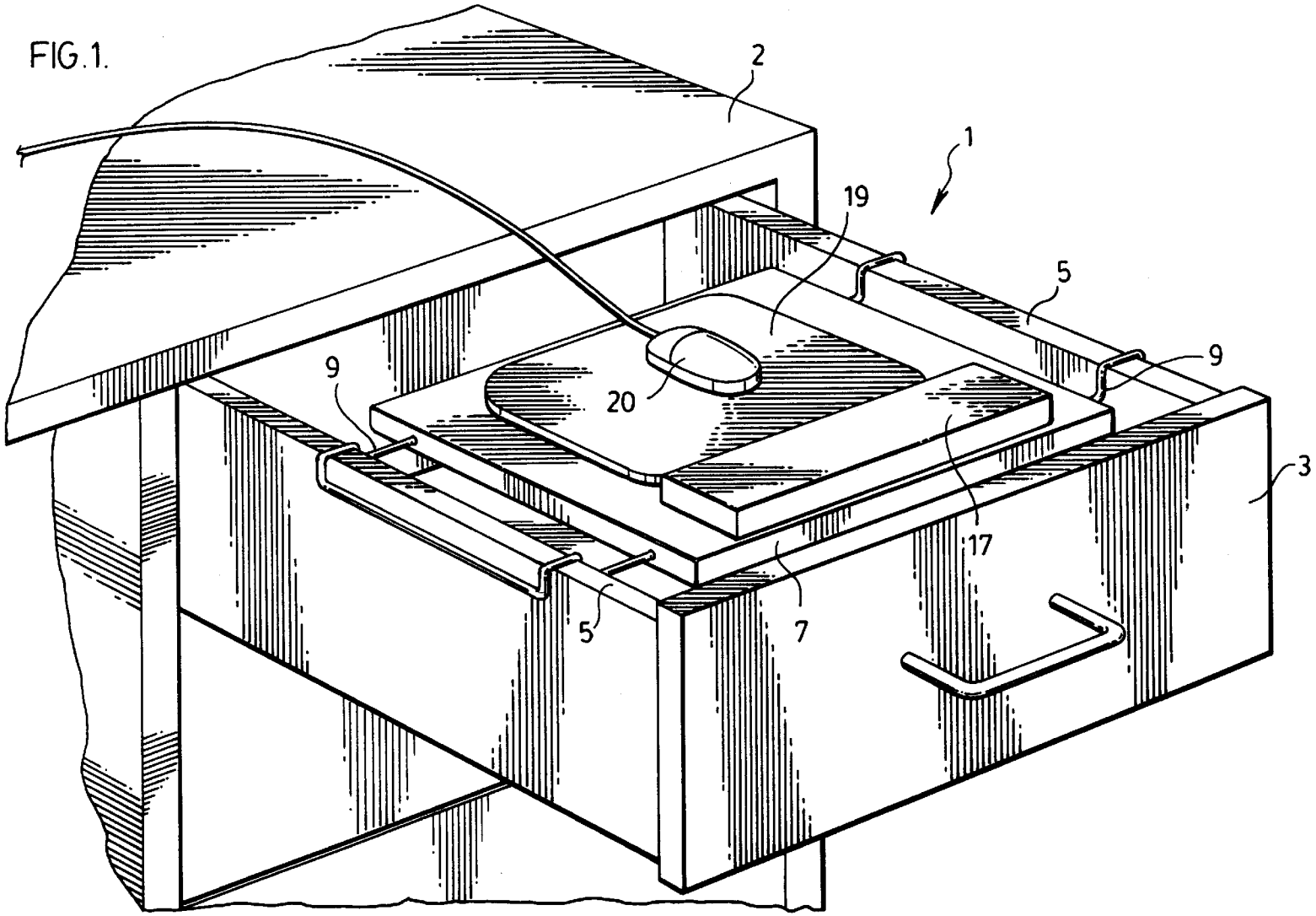
FIG. 1 is a perspective view of a workstation support system comprising of a slide in desk drawer fitted with a suspension structure according to a preferred embodiment of the present invention.

FIG. 1 shows a workstation support system generally indicated at 1. This system comprises a drawer 3 which is slideable between a pulled out and a pushed in position relative to a desk 2. In the particular set up shown, system 1 is used to support a mouse pad 19 and a wrist pad 17 for operating a computer screen controlling mouse 20.

The workstation support system can be used to support a computer keyboard rather than the mouse and wristpad or could be used as a work surface for any other type of workstation which would otherwise be placed on the desktop surface.

Figure 2:
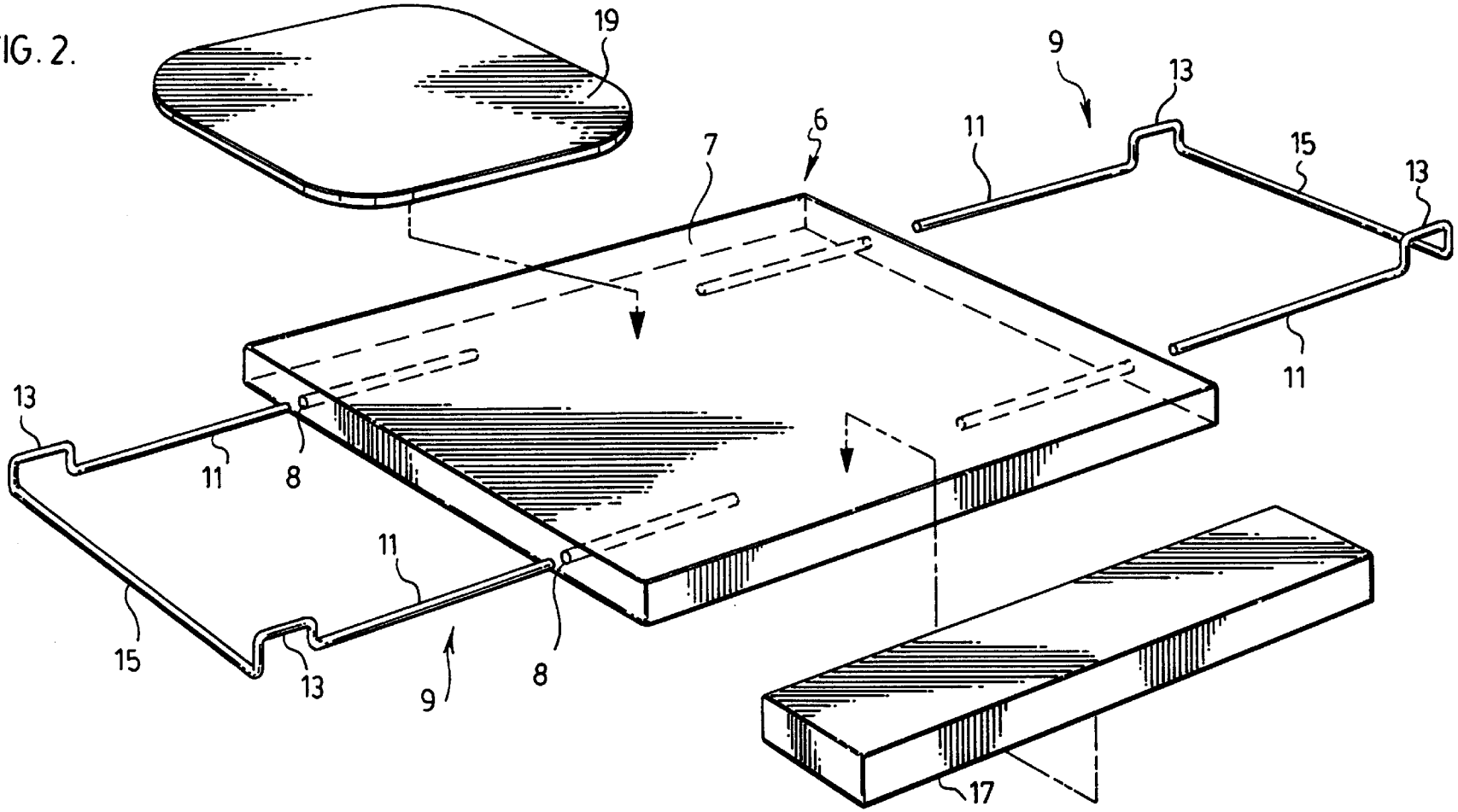
FIG. 2 is an exploded perspective view of the suspension structure removed from the drawer from FIG. 1.

The workstation support system includes, as mentioned above, both the actual desk drawer and a suspension structure generally indicated at 6 in FIG. 2 of the drawings. This suspension structure comprises a rigid support panel 7 having a pair of hangers generally indicated at 9 to either side of the central panel.

Each of the hangers in the embodiment shown is formed by a single steel rod which is bent to form a pair of elongated hanger arms 11. The outer ends of the hanger arms are provided with downwardly turned U shaped hooks 13 connected with one another by a connecting rod portion 15 at right angles to the hanger arms. Panel 7 is provided with a pair of spaced apart openings 8 drilled or otherwise bored well into the panel for receiving the two hanger arms 11. The hanger arms slide into their receiving bores thereby making the two hangers adjustable inwardly and outwardly relative to the panel.

Although the description above describes the hangers as being made of steel rod, it is to be understood that other materials can be used to form the hangers. Furthermore the hanger arms can have different shapes and still be adjustable relative to the center panel.

The panel itself can be made from different materials such as plastic, wood, aluminum and other material which is sufficiently rigid to support a workstation. Note that the centre panel extends across most of the width of the drawer which not only gives a large surface area to the panel, but in addition, shortens the length of the hanger arm which extends outside of the panel so that the hanger arm is very resistant to bending.

Figure 4:
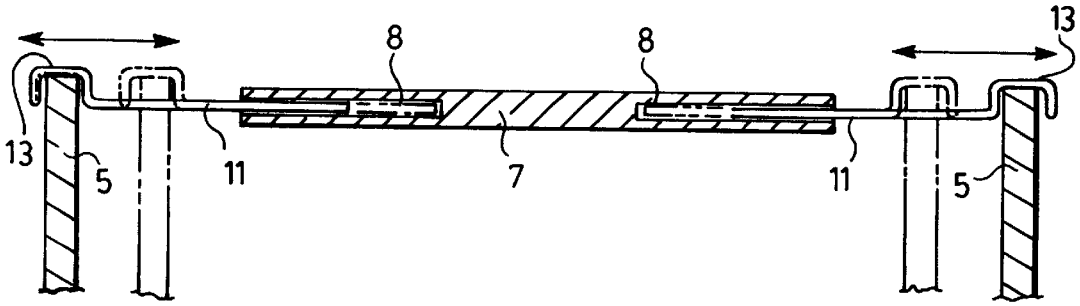
FIG. 4 is a sectional view through the drawer of FIG. 1.

FIG. 4 of the drawings shows that the hooks 13 at the outer ends of the hanger simply drop down over the upper edges of the spaced apart drawer sidewalls 5. FIG. 4 also shows that the inward and outward adjustability of the hangers relative to the panel adapts the workstation support to different drawer widths.

Figure 3:
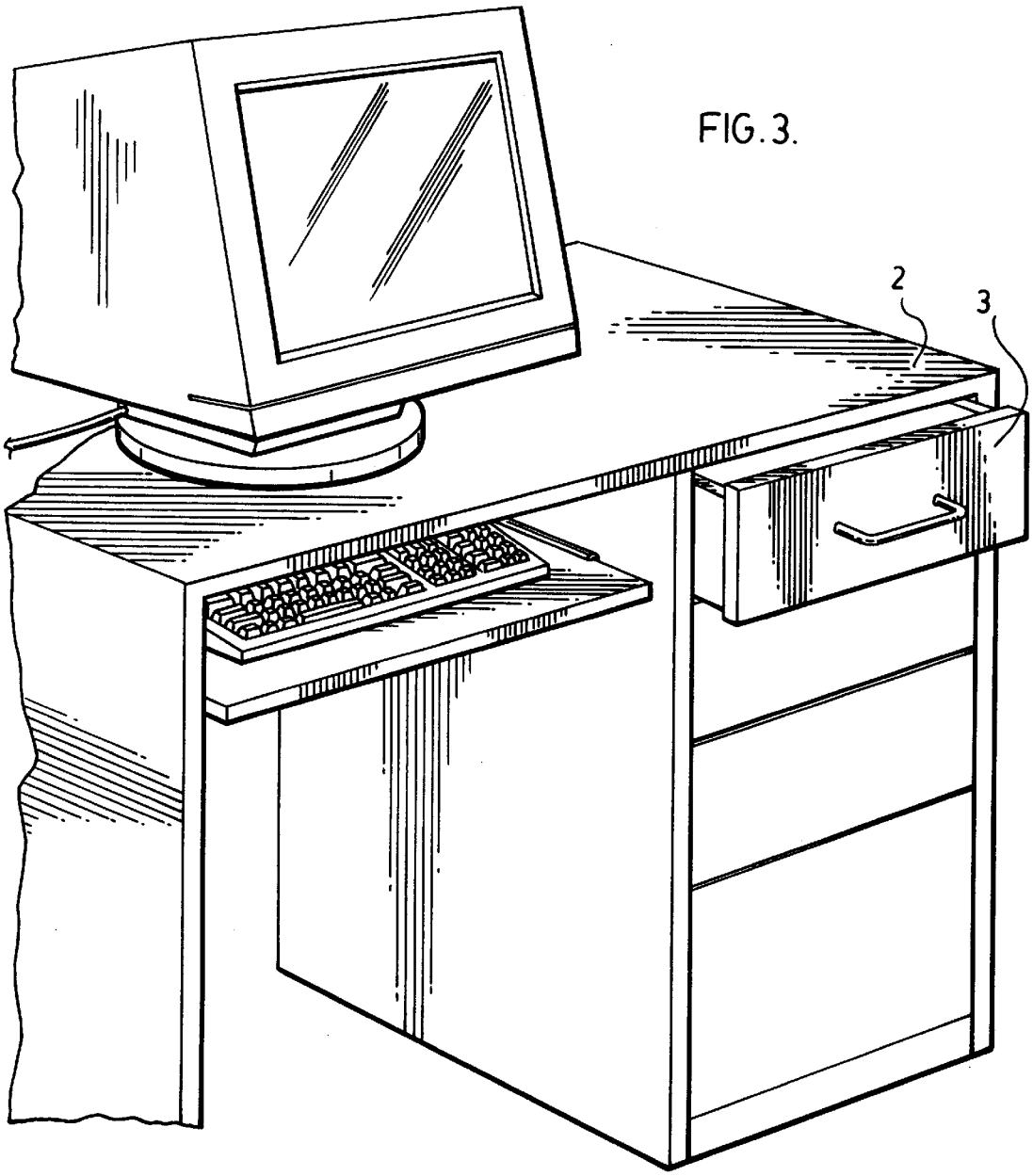
FIG. 3 is a perspective view of the desk into which the drawer of FIG. 1 is fitted.

The hooks 13 on the hangers are of a size that they fit to essentially all drawer sidewalls. By way of example only these hooks can be three quarters of an inch across and one inch in depth. This size and shape of the hooks allows the drawer 3 to open and close even with the suspension structure in place as shown in FIG. 3 of the drawings.

When the suspension structure is mounted to the desk drawer as shown in FIGS. 1 and 4 of the drawings, the U shaping of the hooks on the hanger arms does not allow them to slide in or out relative to the drawer once they have been adjusted to their proper setting. Furthermore the penetration of the hanger arms 11 into the bores or openings 8 of the panel 7 is sufficiently deep such that the support panel cannot slip off the hangers when it is in the drawer.

Figure 5:
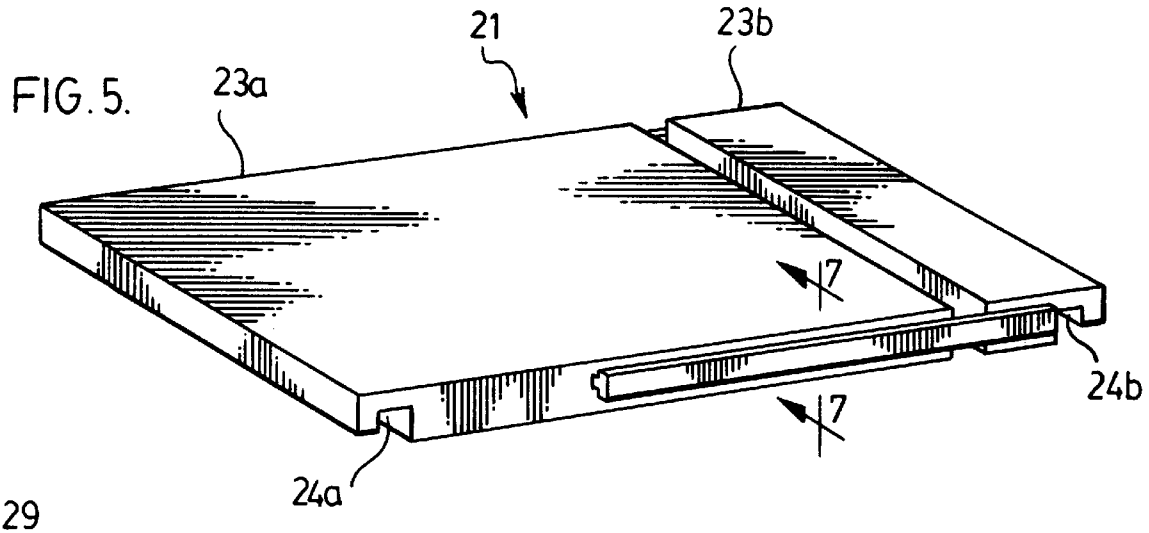
FIG. 5 is a perspective view of a suspension structure according to another preferred embodiment of the invention.
Figure 6:
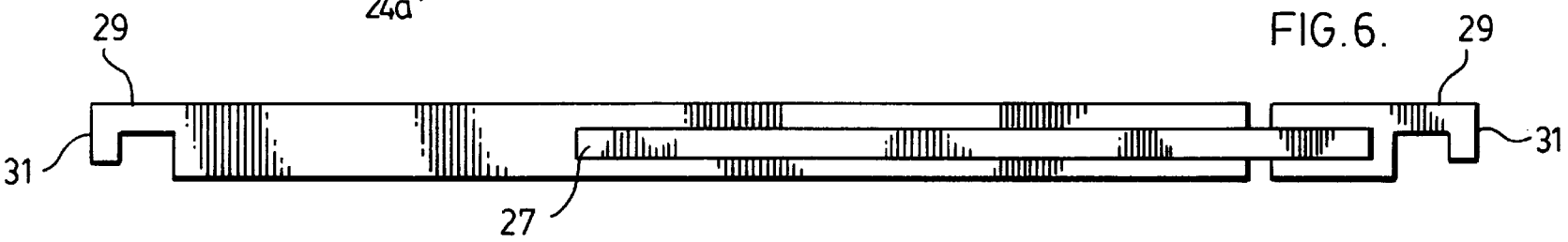
FIG. 6 is a side edge view of the suspension structure of FIG. 5.
Figure 7:
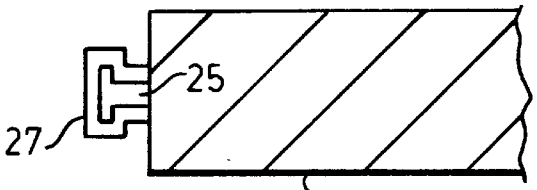
FIG. 7 is an enlarged sectional view along the lines 7—7 of FIG. 5.

FIGS. 5, 6 and 7 show a modified suspension structure generally indicated at 21. This suspension structure comprises a main support panel portion 23*a* and a more minor support panel portion 23*b*. Panel portion 23*a* has an undersurface groove 24*a* while panel portion 23*b* has a groove 24*b*. These two grooves are used to hang the suspension structure from the sidewalls of a drawer.

Rather than having adjustable hangers, suspension structure 21 is in the form of a biparting panel. More particularly support panel portion 23*b* is provided with a pair of side rails 25, one to each side of the support panel portion. These rails are slideably engaged in guides 27 on the opposite sides of support panel portion 23*a* to adjust the two panel portions to adjust to different drawer widths.

As will be appreciated from the drawings the workstation support system allows a mouse and keyboard to be set up at different heights according to user preference in a conventional slide drawer desk by selecting any one of the desk drawers for the suspension structure. The suspension structure has essentially no negative impact on either the operation or the space of the drawer while at the same time providing additional desk working surface when the drawer is pulled outwardly. Furthermore the suspension structure can easily be lifted off of the drawer.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A work station support system comprising a drawer of a desk and a suspension structure comprising a rigid panel and a pair of hangers which hook over spaced apart side walls of said drawer and suspend said panel within said drawer, said suspension structure being adjustable to width of said drawer and said drawer being closable within said desk with said suspension structure in position across said drawer, said rigid panel having a one piece solid construction with bores therein for slideably receiving said hangers.

2. The work station support system as claimed in claim 1 wherein each of said hangers has a one piece construction.

3. The work station support system as claimed in claim 2 wherein each of said hangers comprises a rod of material bent in a configuration comprising a pair of spaced apart parallel arms each of which has an outer end formed into a downwardly opening U-shaped hook, the U-shaped hooks on said arms being connected by a rod portion at right angles to said arms.

4. The work station support system as claimed in claim 3 wherein said parallel arms of each hanger are slideably fitted into said bores from opposite sides of said rigid panel.

* * * * *